United States Patent [19]

Schulman

[11] 4,193,533

[45] Mar. 18, 1980

[54] BOX CONSTRUCTION

[75] Inventor: Kenneth B. Schulman, New York, N.Y.

[73] Assignee: Millen Industries, Inc., New York, N.Y.

[21] Appl. No.: 938,334

[22] Filed: Aug. 31, 1978

[51] Int. Cl.[2] ..... B65D 5/22

[52] U.S. Cl. ..... 229/34 R

[58] Field of Search ..... 229/23 R, 34 R, 36

[56] References Cited

U.S. PATENT DOCUMENTS

| | | | |
|---|---|---|---|
| 1,498,375 | 6/1924 | Helfrich | 229/34 R |
| 1,956,124 | 4/1934 | Jackson | 229/34 R |
| 1,965,951 | 7/1934 | Williams | 226/34 R |
| 2,056,094 | 9/1936 | Claff | 229/34 R |
| 2,132,776 | 10/1938 | Claff | 229/34 R |
| 2,544,101 | 3/1951 | Oxley | 229/23 R |
| 2,944,719 | 7/1960 | Arneson | 229/31 R |
| 3,533,547 | 10/1970 | Houston | 229/34 R |

*Primary Examiner*—Davis T. Moorhead

*Attorney, Agent, or Firm*—Gottlieb, Rackman & Reisman

[57] ABSTRACT

A box construction is characterized by double-layered side walls and by a paper wrapping extending over the exterior surface of the box and continuing over each interior side wall and each interior end wall. Each double-layered side wall consists of a single thickness of paperboard, covered on one side with paper wrap and folded inwardly over itself, so that the external paper wrap also covers the interior side walls and the interior end walls, giving the box a desirable "finished" appearance.

1 Claim, 4 Drawing Figures

BOX CONSTRUCTION

This invention relates to boxes, and more specifically, to an improved box construction in which the interior of the box has a pleasing decorative appearance and is quite sturdy.

In box construction, it has been common practice to cover the exterior surface of the box with a paper wrapper, in order to give the box a decorative appearance. However, the interior of the box has generally remained uncovered, thereby exposing the unsightly cardboard or paperboard material of which the box is constructed.

In recent years, box constructions having single-layered side and end walls, with a double-layered "lip" extending around the entire inside perimeter of the box, have become quite common. Generally, the "lip" is an extension of the outer wall of the box, and is covered with the same wrapper which adorns the exterior of the box. However, the "lip" generally extends downwardly only about one-half inch below the top edge of the box, thereby leaving the remainder of the interior side and end walls of the box uncovered, and giving the box an "unfinished" appearance. Furthermore, these uncovered areas of the box are only a single layer thick, and are therefore not strong.

It it therefore the principal object of this invention to provide a box construction, the interior side and end walls of which are entirely covered with the same paper wrapper which adorns the exterior of the box, thereby giving the interior of the box a desirable "finished" appearance.

A further object of this invention is to provide a box construction having side walls of double thickness, thereby enhancing the strength of the box.

Briefly, in accordance with the principles of the present invention, a box is made from a one-piece cardboard blank, one face of which is covered by a decorative paper wrapper. The blank is cut and creased such that when it is folded into an assembled box, the side walls are of double thickness, and the entire exterior surface and substantially all of the interior wall surface present the decorative paper wrap outwardly, thereby enhancing both the strength and the appearance of the box. A cover for the box is also provided with a similar paper wrap, lending an additional pleasing aspect to the box.

Other objects, features and advantages of this invention will become more readily apparent from an examination of the following specificaton when taken in conjuction with the accompanying drawings, wherein.

Figure 1:
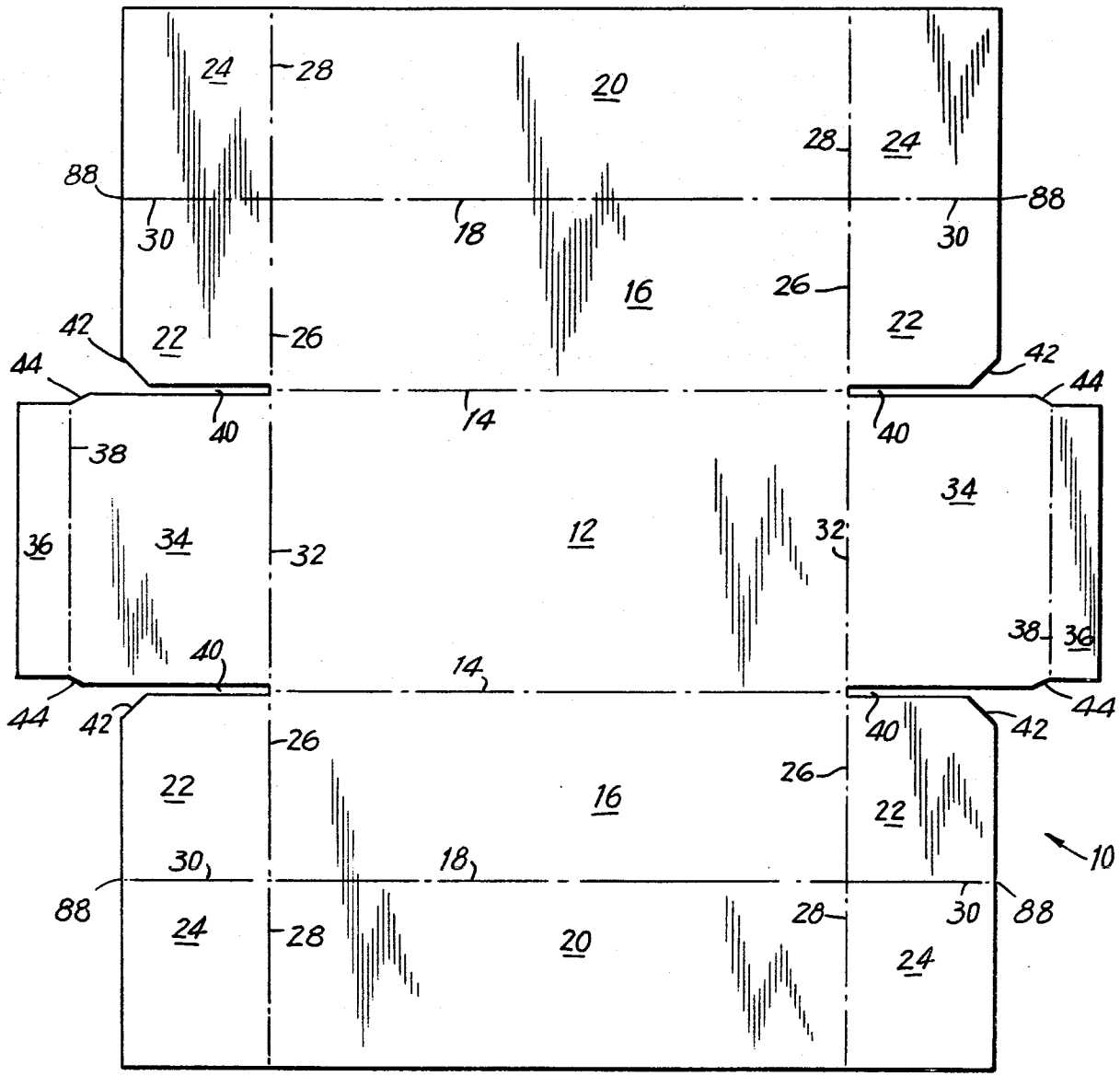
FIG. 1 is a plan view illustrating the preferred form of the pre-cut and pre-creased flat box blank from which the box of the present invention is made.

Referring now to the drawings, and in particular to FIG. 1, the preferred form of a flat box blank for use in accordance with the present invention is generally designated 10. Box blank 10 is generally formed of cardboard or paperboard of any suitable character, preferably being thin and flexible, but also opague and relatively strong. The upper surface of the box blank 10, as shown in FIG. 1, is unornamented. However, the entire reverse side of the blank (not shown) is covered with a paper wrap, preferably bearing a decorative design, which is co-extensive with the box blank 10. The paper wrapper may be formed integrally with the cardboard blank, or may be formed separately, and then cut congruently with the blank 10, after which the paper wrapper may be attached to the blank in any conventional manner such as with an adhesive.

Box blank 10 is pre-creased to define a central portion 12, which is separated by the creases 14 from the side panels 16, which are in turn separated by the creases 18 from side panel flaps 20. The side panels 16 and the side panel flaps 20 have attached thereto at both ends thereof, extensions 22 and 24, respectively, which are separated from the side panels 16 and the side panel flaps 20, respectively, by the creases 26 and 28. Extensions 22 and 24 are themselves separated by the creases 30.

At the ends of central portion 12, but separated therefrom by the creases 32, are end panels 34. Each end panel 34 has an end panel extension 36 of reduced dimension, which is separated therefrom by creases 38.

As shown in FIG. 1, end panels 34 and end panel extensions 36 are separated from side panel extensions 22 by slits 40, which extend from the creases 14 to the edge of the blank 10. The open ends of slits 40 are formed by the cut-off corners 42 of side panel extensions 22, and by the cut-off corners 44 of end panels 34.

Figure 2:
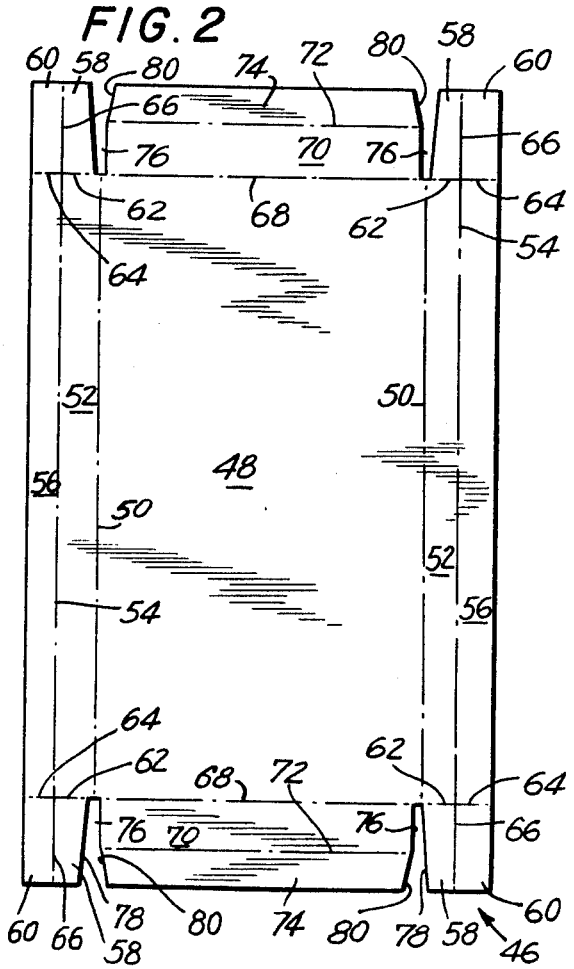
FIG. 2 is a plan view of the preferred form of a pre-cut and pre-creased flat blank for a box cover for use with the present invention.

Referring now to FIG. 2, a preferred version of a flat cardboard blank for a box cover is generally designated 46. Blank 46 is generally similar in construction to blank 10, being fabricated of cardboard or paperboard, and having a paper wrapper on the reverse side thereof (not shown). In general, the paper wrapper which is applied to the reverse side of blank 46 either matches or is complementary to the design of the paper wrapper on the reverse side of blank 10.

Blank 46 is also pre-cut and pre-creased to define a central portion 48, which is separated by creases 50 from side wings 52. Side wings 52 are in turn separated by creases 54 from side wing flaps 56. Side wings 52 and side wing flaps 56 have attached thereto at the ends thereof extensions 58 and 60, which are separated from side wings 52 and side wing flaps 56, respectively, by creases 62 and 64. The extensions 58 and 60 are themselves separated by creases 66.

At the ends of central portion 48, but separated therefrom by the creases 68, are end wings 70, and attached thereto although separated therefrom by the creases 72, are end wing flaps 74. The end wings 70 and the end wing flaps 74 are separated from the side wing extensions 58 by the slits 76, which extend from the scorings 50 to the edge of the blank 46. As shown in FIG. 2, the open ends of slits 76 are formed by the tapered edges 78, of side wing extensions 58, and by the tapered edges 80 of end wing flaps 74.

The box blank 10 is folded into an assembled box having double-layered side walls substantially in the following manner: The blank is folded along the lines of the creases 18 and the aligned creases 30 so that the two side panel flaps 20 and the four side panel flap extensions 24 are bent upwardly at right angles (from the plane of the paper as viewed in FIG. 1), and then downwardly through a total angle of 180°, so that the side panel flaps 20 and the side panel flap extensions 24 overlie the side panels 16 and the side panel extensions 22, respectively, in face-to-face contact. These portions may be permanently bonded to one another by the use of a conventional adhesive or glue, which may be applied prior to the commencement of the folding operation. Whatever pressure is required to adhere these portions is subsequently applied during the folding operation. In this manner, double-layered side walls 82 are formed from the overlying relationship of side panels 16 and side panel flaps 20, and double-layered side wall extensions 84 are formed from the overlying relationship of side panel extensions 22 and side panel flap extensions 24 (see FIGS. 3 and 4).

In order to complete the assembly of the box, the blank 10 is then folded along the creases 26 and 28 so that the four side wall extensions 84 are bent upwardly at right angles (from the plane of the paper as viewed in FIG. 1). The blank is then folded along creases 14 so that the two side walls 82 are also bent upwardly at an angle of 90° to the central portion 12, as shown in FIGS. 3 and 4, and the edges 88 of each pair of side wall extensions 84 are joined, by means of a suitable adhesive, and at approximately the mid-point of their combined overall length, to form the interior end walls 89 of the box.

Finally, the blank is folded along the creases 32 so that the two end panels 34 are bent upwardly at right angles to the central portion 12 to form the exterior end walls **89*a* of the box. A suitable adhesive is then applied to the inner surface of end panel extensions 36, and they are folded inwardly along creases 38 through an angle of 180° over the interior end walls 89. Pressure may then be applied to assure the adherence of end panel extensions 36 to interior end walls 89. As shown best in FIG. 3, end panel extensions 36, when folded into place, form end wall lips 89*b* which extend part of the way down from the top of the box along the interior end walls 89, covering only the upper portion 89*c* of each interior end wall 89**.

Figure 3:
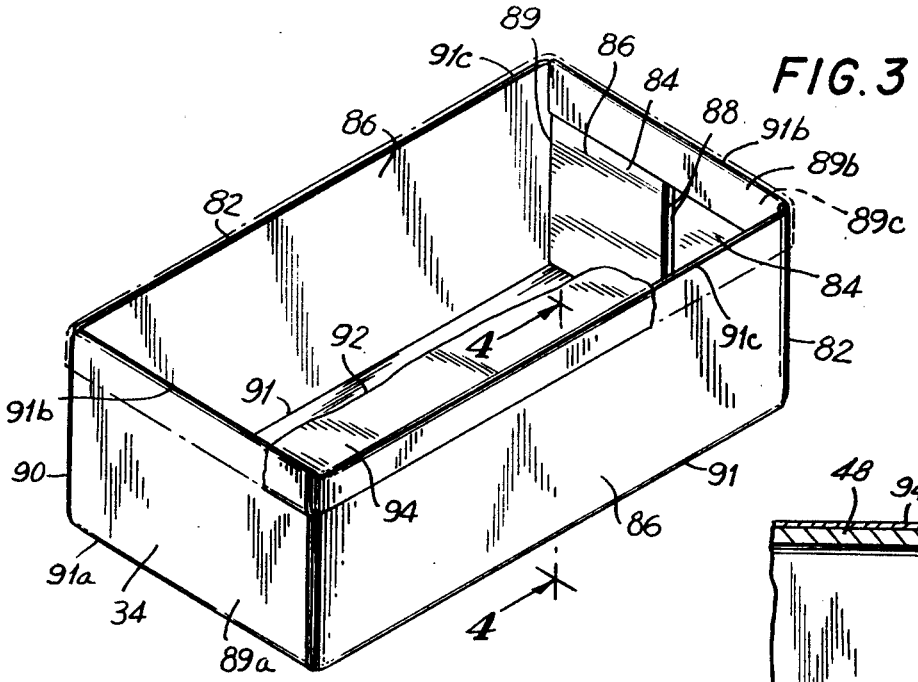
FIG. 3 is a perspective view, partially broken away, of the assembled box, illustrating a portion of the interior thereof, as well as a portion of the box cover mounted thereon.
Figure 4:
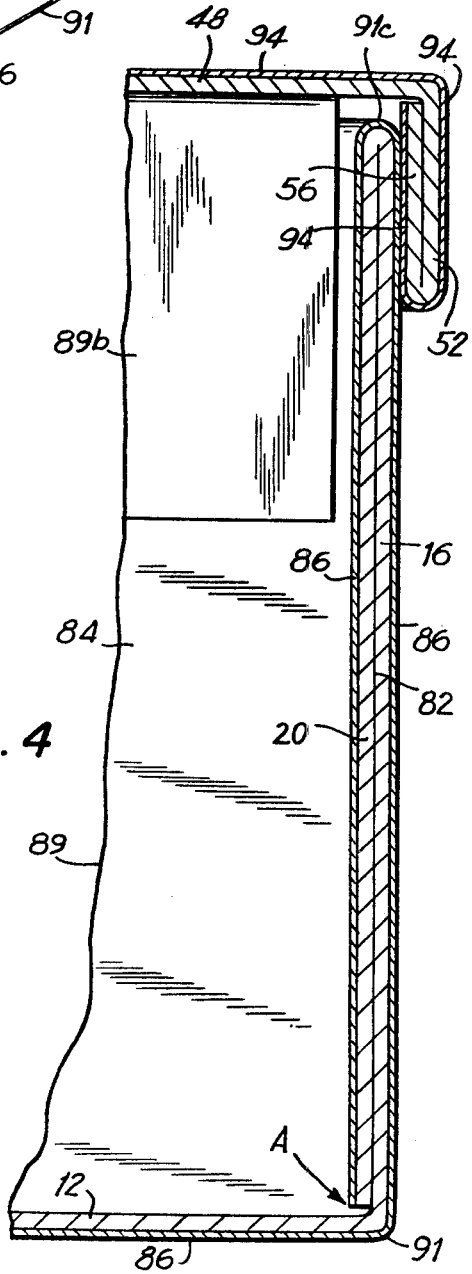
FIG. 4 is an enlarged cross-sectional view of the interior of the box of FIG. 3, taken substantially along the lines 4—4 of FIG 3.

After the foregoing steps have been executed, the folding operation will then be complete, yielding an assembled box 90 as illustrated in FIG. 3. It will be noted that the interior surfaces of side walls 82 and the interior surfaces of end walls 89 are covered with the same decorative paper wrapping 86 which covers all of the exterior surfaces of the box 90, providing a pleasing finished appearance for the interior of the box. As shown at A in FIG. 4, the paper wrapping 86 extends all of the way down from the top of the box along the interior of side walls 82 to the bottom of the box.

Moreover, it will be seen from a comparison of FIGS. 1 and 3 that by folding the blank 10 in the manner set forth above, a shoe box 90 with sharply defined edges is formed. The two opposite lower side edges 91 of central portion 12 are formed by the folds along creases 14. Similarly, the opposite lower end edges **91*a* of central portion 12 are formed by the folds along creases 32**.

The folding operation defines the rim of the box as well. Upper end edges **91*b* are formed by the folds along creases 36, while upper side edges 91*c* are formed by the folds along creases 18, thereby giving the box sturdy, doubled-layered side walls 82**.

By performing a similar folding operation upon box cover blank 46, a completed box cover 92, having a matching or complementary paper wrapper 94 on the outer surfaces and innerwalls thereof, may be formed for use with the box 90, as shown in FIGS. 3 and 4.

It may be seen from the foregoing, that the embodiments described herein are by way of illustration and not of limitation, and that various changes in and other modifications of the construction, composition, and arrangement of parts are possible in light of the above teachings. Accordingly, it is to be understood that other embodiments of this invention could be utilized without departing from the spirit and scope of the present invention as set forth in the appended claims.

I claim:

1. A box structure formed from a blank covered on one side thereof with a first paper wrap, the box structure comprising a substantially flat central portion, side walls adjacent to and substantially perpendicular to a first pair of opposite edges of the central portion, each of said side walls comprising a double layer of material formed by folding a marginal portion of the blank onto itself such that the first paper wrap covers the interior surfaces of said walls, each of said side walls also having a pair of double layer and extensions of substantially the same size and adapted to be sent inwardly and joined to form the interior end walls of the box, each of said interior end walls having an upper portion and a lower portion, and exterior end walls adjacent to and substantially perpendicular to a second pair of opposite edges of the central portion, each said pair of double layer end extensions being joined to form an interior end wall of the box at substantially the midpoint of the adjacent exterior end wall of the box, each of said exterior end walls including an end wall lip adapted to be bent inwardly over and to cover the upper portion of each of said interior end walls to form a box having the first paper wrap extending over the entire exterior surface of the box and continuing over each interior end wall of the box and along the interior surface of each of said side walls to one edge of said first pair of opposite edges of the central portion of the box.

* * * * *